United States Patent [19]

Bonnell

[11] Patent Number: 4,832,095

[45] Date of Patent: May 23, 1989

[54] DEVICE FOR COLLECTING VISCOUS FLUIDS

[76] Inventor: Donald G. Bonnell, 4649 W. Sierra, Glendale, Ariz. 85304

[21] Appl. No.: 79,949

[22] Filed: Jul. 31, 1987

[51] Int. Cl.[4] ..... B67C 11/00

[52] U.S. Cl. ..... 141/106; 141/98; 141/340; 141/342; 141/339; 248/94

[58] Field of Search ..... 222/108, 460; 141/98, 141/100–107, 319–322, 364, 331–334, 339–343, 363, 375, 326, 327; 211/74; 248/94, 222.4, 311.3, 312, 312.1

[56] References Cited

U.S. PATENT DOCUMENTS

| | | | |
|---|---|---|---|
| 92,791 | 7/1869 | Burwell | 141/339 X |
| 118,051 | 8/1871 | Price | 141/98 |
| 478,303 | 7/1892 | Allgood | 141/332 |
| 578,671 | 3/1897 | Wisdom | 141/106 |
| 616,737 | 12/1898 | Schuster | 248/311.3 |
| 637,963 | 11/1899 | Howard | 141/106 |
| 1,387,789 | 8/1921 | Lyons | 141/339 |
| 1,861,619 | 6/1932 | Bellmer | 141/106 X |
| 2,071,944 | 2/1937 | Hoffman | 141/106 X |
| 2,230,180 | 1/1941 | Collins | 141/106 |
| 3,643,704 | 2/1972 | Carr | 141/106 |
| 3,654,969 | 4/1972 | Vazquez et al. | 141/106 |
| 4,112,984 | 9/1978 | Guglia et al. | 141/98 |
| 4,665,958 | 5/1987 | Holloway et al. | 141/106 |
| 4,706,720 | 11/1987 | Pattison et al. | 141/327 |

FOREIGN PATENT DOCUMENTS

| | | | |
|---|---|---|---|
| 8604318 | 7/1986 | PCT Int'l Appl. | 141/332 |

*Primary Examiner*—Henry J. Recla
*Assistant Examiner*—Ernest G. Cusick
*Attorney, Agent, or Firm*—Cahill, Sutton & Thomas

[57] ABSTRACT

A device for collecting viscous fluid from a plurality of vessels includes a funnel member, a plurality of vessel retainer elements disposed in the open top portion of the funnel member for holding the vessels in inverted positions, and an open-mouthed receptacle demountably attached to the bottom of the funnel member for receiving the fluid.

16 Claims, 1 Drawing Sheet

DEVICE FOR COLLECTING VISCOUS FLUIDS

BACKGROUND OF THE INVENTION

1. Field of the Invention

This invention relates in general to fluid collection devices and, more particularly, to a collection device for receiving viscous fluids from a plurality of vessels such as oil cans.

2. Description of the Prior Art

One problem which is very commonly experienced by individuals changing the oil in their automotive vehicles is that because the new oil being added to the engine is highly viscous, it takes an inordinate amount of time to drain out of its original vessel. Some individuals may be willing to wait until every last drop of oil has been poured. But most people lose patient and quite, allowing a small residue of oil to remain on the side walls and bottom of the vessel. This small residue goes to waste when the vessel is thrown out. While the amount of waste per vessel may seem inconsequential, the total quantity of lost oil becomes appreciable when it is considered that an average oil change requires as many as five or six cans of oil. In some cases, as much as a quart of oil is lost. Similar problems may be experienced when draining other types of viscous fluid from their containers for various different applications.

To the best of my knowledge, no device for collecting residual liquid from a plurality of oil cans or other vessels containing viscous fluid has ever been developed. Therefore, a need exists for a new and useful collection device which eliminates unnecessary waste of fluid.

SUMMARY OF THE INVENTION

In accordance with the present invention, a new and useful collection device is disclosed for receiving viscous fluid from a plurality of vessels.

The collection device comprises a funnel member having a substantially open top portion, an inwardly sloping side wall portion, and a bottom portion defining an outlet port. A plurality of vessel retainer elements are disposed in the top portion of the funnel member for holding a plurality of inverted vessels. Preferably, each retainer element comprises a pair of concentric rings, including a large diameter ring for holding a conventional cylindrical type oil can and a small diameter ring for holding a narrow-necked vessel. Each ring defines a fluid passage for allowing viscous fluid to flow from one of the inverted vessels to the interior of the funnel member. Attachment means such as an internally threaded screw cap is provided on the bottom portion so as to be associated with the outlet port of the funnel member for demountably mounting the funnel member over the open mouth of a receptacle which receives the collected liquid.

To use the device, it is simply necessary to place a number of vessels in inverted position in the retainer elements of the funnel member, and to leave the vessels in this position for an extended period of time, perhaps overnight. The viscous fluid clinging to the side walls and bottom of the vessels will then be forced by gravity to drain out of the vessels, through the fluid passages in the retainer elements, and down the inwardly sloping side wall portion of the funnel member. The fluid will then exit the funnel member through the outlet port in the bottom portion, and will finally be collected in the receptacle below. The collected fluid can be stored away and used later as needed.

Accordingly, it is an object of this invention to provide a collection device for receiving residual viscous fluids from a plurality of vessels.

Another object of the device is to provide a fluid collection device having a plurality of retainer elements for holding both cylindrical cans and narrow-necked bottles in inverted positions for collecting residual viscous fluids therefrom and depositing the collected fluids in a suitable receptacle.

Still another object of the device is to provide a fluid collection device which can be simply and inexpensively manufactured from readily available materials.

The foregoing and other objects of the present invention, as well as the invention itself, may be more fully understood from the following description when read in conjunction with the accompanying drawings.

DESCRIPTION OF THE PREFERRED EMBODIMENT

Figure 1:
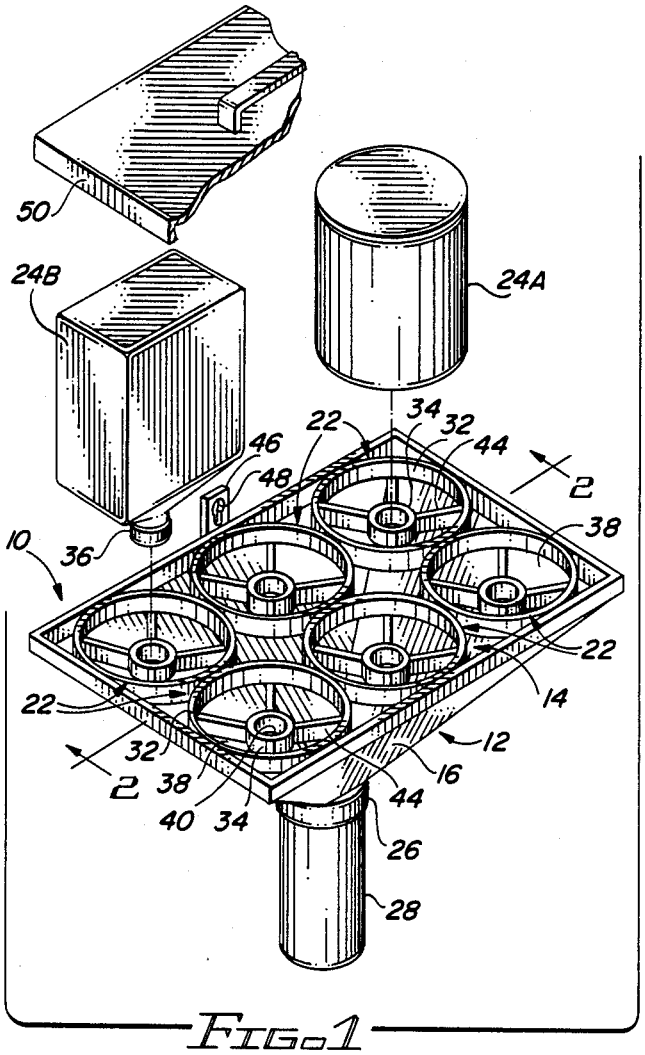
FIG. 1 is a perspective view showing the collection device of the present invention, with a number of viscous fluid receptacles and a cover member in exploded relationship thereto.
Figure 3:
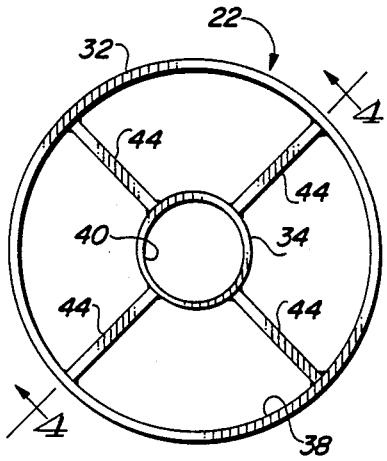
FIG. 3 is a top view of one of the retainer elements of the collection device of the present invention.
Figure 4:
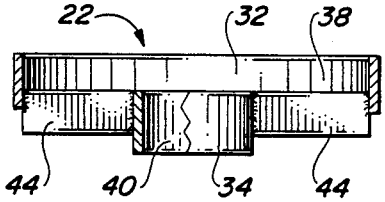
FIG. 4 is a sectional view taken through line 4—4 of FIG. 3.
Figure 2:
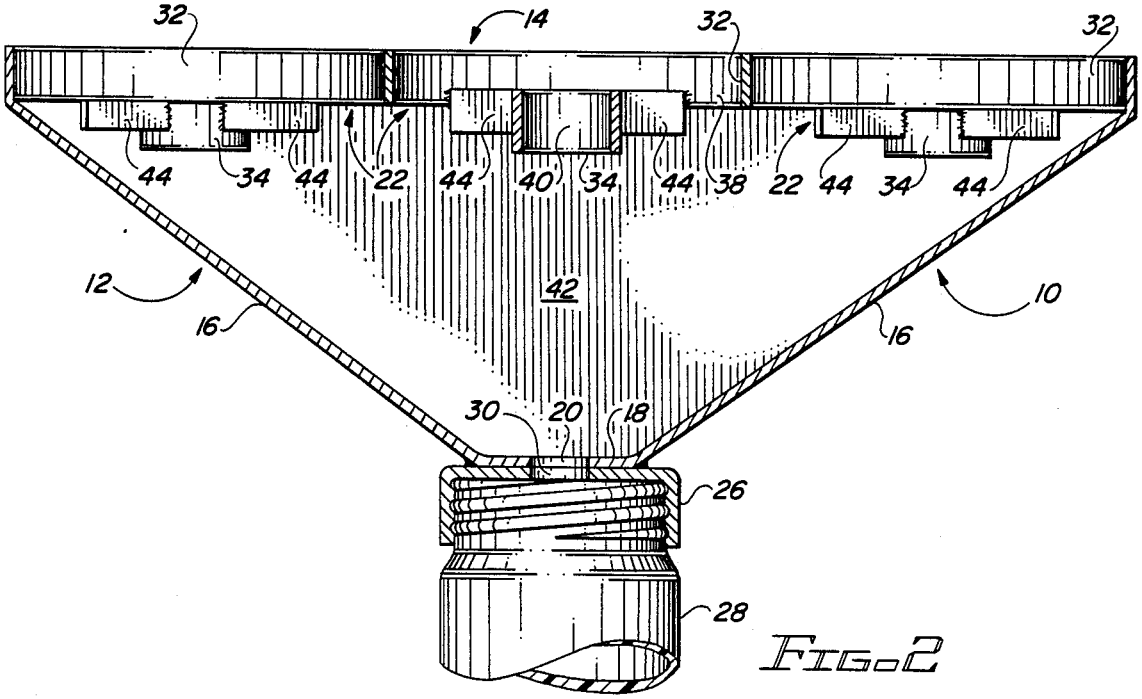
FIG. 2 is an enlarged sectional view taken through line 2—2 of FIG. 1.

Referring more particularly to the drawings, FIG. 1 shows the fluid collection device of the present invention which is indicated in its entirety by the numeral 10.

The collection device 10 comprises a funnel member 12 having a substantially open top portion 14, an inwardly sloping side wall portion 16 which may be configured either as a plurality of tapered, planar walls as shown or as a single conical wall (not shown), and a bottom portion 18 defining an outlet port 20. A plurality of vessel retainer elements 22 are disposed in the top portion 14 of the funnel member 12 for holding a plurality of inverted vessels 24A, 24B. Attachment means such as an internally threaded screw cap 26 is provided on the bottom portion of the funnel member 16 for demountably mounting the funnel member 16 over the open mouth of a receptacle 28. The screw cap 26 defines an aperture 30 which is aligned with the outlet port 20 of the funnel, allowing liquid to escape into the receptacle 28.

Preferably, each of the vessel retainer elements 22 comprises a pair of concentric rings, including a large diameter ring 32 which is dimensioned to closely encircle the open mouth of a conventional wide-mouthed cylindrical type oil can 24A, and a small diameter ring 34 which is dimensioned to closely encircle the neck 36 of a plastic oil bottle 24B and which is located slightly below the large diameter ring 32. The outer ring 32 of each retainer element 22 defines a large area flow passage 38 and the inner ring 34 defines a small area flow passage 40 for allowing fluid communication between the vessels 24A, 24B and the interior area 42 of the funnel member 12. In addition, a plurality of ribs 44 extend radially between the outer and inner rings 32 for holding the inner ring 34 in place and supporting the vessels 24A, 24B. In the illustrated embodiment, six of the retainer elements 22 are provided, since this corresponds to the number of oil vessels commonly used in an oil change, but the number of retainer elements may be varied depending on the application for which the fluid collection device 10 is intended.

To use the device 10, it is simply necessary to place a number of vessels 24A, 24B in inverted position in the retainer elements 22, and to leave the vessels in this position for an extended period of time, perhaps overnight. The viscous fluid clinging to the side walls and bottom of the vessels will then be forced by gravity to drain out of the vessels, through the fluid passages 38, 40 in the retainer elements 22, and down the inwardly sloping side wall portion 16 of the funnel member 12. The fluid will then exit the funnel member 12 through the outlet port 20 in the bottom portion 18 and the aligned aperture 30 in the screw cap 26, and will finally be collected in the receptacle 28 below. The collected fluid can then be stored away and used later on as needed.

The funnel member 12 is preferably provided with hanging means such as an upwardly extending tab 46 defining a keyhole-shaped aperture 48 for conveniently hanging the device 10 from a nail or the like (not shown) on a garage wall or elsewhere during the lengthy period of waiting for the fluid to fully drain from the vessels 24A, 24B. In addition, it is desirable to provide a removable cover 50 for preventing dirt and other contaminants from entering the funnel member 12 when the device is not in use.

The funnel member 12 can easily be manufactured from sheet metal with the retainer elements 22 and screw cap 26 being welded into place as shown. Alternatively, the entire device can be formed of plastic using conventional molding techniques.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A device for collecting residual viscous fluid from a plurality of opened vessels, said device comprising:

(a) a funnel member having a substantially open top portion, an inwardly and downwardly sloping side wall portion, and a bottom portion defining an outlet port, (b) vessel retainer means disposed in the top portion of said funnel member for holding the opened vessels in inverted fluid draining positions, said vessel retainer means comprising a pair of concentric rings, including a large diameter ring for selectively holding a cylindrical vessel and a small diameter ring for selectively holding a narrow-necked vessel, each of said rings defining fluid passage means for fluid to flow out of a selected one of said vessels to the interior of said funnel member; and (c) attachment means on the bottom portion of said funnel member and defining an opening which aligns with the outlet port of said funnel member for demountably mounting said funnel member over a receptacle for collecting fluid.

2. The device of claim 1, further comprising an open mouthed receptacle demountably mounted on said attachment means for receiving fluid from the vessels.

3. The device of claim 2, further comprising hanging means on said funnel member for hanging said device from a wall.

4. The device of claim 3, in which said hanging means comprises an upstanding tab defining a keyhole-shaped aperture.

5. The device of claim 1, in which said attachment means comprises an internally threaded screw cap depending from said funnel member.

6. The device of claim 1, further comprising a removable cover for closing the open top portion of said funnel member for protecting the interior of said funnel member from contamination when said device is not in use.

7. An oil collection device, said device comprising:

(a) a funnel member having a substantially open top portion, an inwardly and downwardly sloping side wall portion, and a bottom portion defining an outlet port;

(b) at least one vessel retainer element disposed in the top portion of said funnel member for holding an opened oil vessel in an inverted position for draining residual oil therefrom, said oil vessel retainer element comprising a pair of concentric rings, including a large diameter ring for selectively holding a wide-mouthed cylindrical oil can and a small diameter ring for selectively holding a narrow-necked oil bottle; and (c) attachment means on the bottom portion of said funnel member and defining an opening which aligns with the outlet port of said funnel member, said attachment means being for demountably mounting said funnel member over a receptacle for collecting the residual oil.

8. The device of claim 7, in which said attachment means comprises an internally threaded screw cap depending from the bottom portion of said funnel member and having the opening formed therethrough which aligns with said outlet port in the bottom portion of said funnel member.

9. The device of claim 7, further comprising an open mouthed receptacle demountably mounted on said attachment means for receiving and collecting the drained residual oil from said funnel member.

10. The device of claim 7, further comprising hanging means on said funnel member for hanging said device from a wall.

11. The device of claim 10, in which said hanging means comprises an upstanding tab defining a keyhole-shaped aperture.

12. The device of claim 7, further comprising a removable cover for closing the open top portion of said funnel member for protecting the interior of said funnel member from contamination when said device is not in use.

13. An oil collection device for collecting residual oil from a plurality of opened oil vessels, said device comprising:

(a) a funnel member having a substantially open top portion, an inwardly and downwardly sloping side wall portin, and a bottom portion defining an outlet port;

(b) a plurality of vessel retainer means disposed in the open top portion of said funnel member, each of said vessel retainer means being configured to support an oil vessel in an inverted oil draining attitude and defining passage means for allowing oil to flow from the vessel to the interior of the funnel member, each of said vessel retainer means comprising:

(i) a large diameter ring dimensioned of closely encircle a, wide-mouthed cylindrical oil can;

(ii) a small diameter ring located concentrically within and below said large diameter ring, said small diameter ring being dimensioned to closely encircle the neck of a narrow-necked oil bottle; and (iii) a plurality of ribs extending radially inwardly between said large diameter ring and said small diameter ring for integral interconnection thereof; and (c) an open mouthed receptacle demountably attached to the bottom portion of said funnel member beneath said outlet port for collecting oil from said funnel member.

14. The device of claim 13, further comprising hanging means on said funnel member for hanging said device from a wall.

15. The device of claim 14, in which said hanging means comprises an upstanding tab defining a keyhole-shaped aperture.

16. The device of claim 13, further comprising a removable cover for closing the open top portion of said funnel member for protecting the interior of said funnel member from contamination when said device is not in use.

* * * * *